US006064283A

United States Patent [19]

Asada

[11] Patent Number: 6,064,283

[45] Date of Patent: May 16, 2000

[54] DIELECTRIC FILTER

[75] Inventor: Naoyuki Asada, Mine, Japan

[73] Assignee: Sumitomo Metal (SMI) Electronics Device, Inc., Mine, Japan

[21] Appl. No.: 09/124,223

[22] Filed: Jul. 29, 1998

[30] Foreign Application Priority Data

Jul. 30, 1997 [JP] Japan ..... 9-204135

[51] Int. Cl.[7] ..... H01P 1/201; H01P 11/00

[52] U.S. Cl. ..... 333/202; 333/206

[58] Field of Search ..... 333/202, 206, 333/207, 222

[56] References Cited

U.S. PATENT DOCUMENTS 4,668,925 5/1987 Towatari et al. ..... 333/222 X
4,799,033 1/1989 Igarashi et al. ..... 333/134
4,879,533 11/1989 de Muro et al. ..... 333/206
4,937,542 6/1990 Nakatuka ..... 333/206 X
5,162,760 11/1992 Phillips et al. ..... 333/206
5,210,511 5/1993 Izumi et al. ..... 333/219.1 X
5,818,312 10/1998 Noguchi et al. ..... 333/206 X

*Primary Examiner*—Seungsook Ham
*Attorney, Agent, or Firm*—Arent Fox Kintner Plotkin & Kahn PLLC

[57] ABSTRACT

An Ag electrode coated all over the surface of a dielectric block by dipping is partially abraded off for formation of input-output terminal electrodes. Post-firing deformation of the dielectric block due to a green density difference during pressing is thus eliminated by abrasion, thereby making an input-output terminal electrode mount face so flat that the input-output terminal electrodes can be formed with high precision. Chamfered edge areas for preventing chipping of the dielectric block are also removed by abrasion, so that the input-output terminal electrodes can be formed as far as the extreme end of the input-output terminal electrode mount face. The input-output capacity value of the dielectric filter can thus be stabilized with minimized variations of the filter characteristics. It is accordingly possible to provide an inexpensive dielectric filter through a reduced number of process steps, with no need of any regulation of resonance frequency yet with improved yields upon non-regulation.

9 Claims, 6 Drawing Sheets

DIELECTRIC FILTER

BACKGROUND OF THE INVENTION

The present invention relates to a dielectric filter which may be used as a microwave filter, for instance, and in which an internal conductor and an external conductor, each formed of dielectric material, resonate.

A surface mount type dielectric filter used so far as a microwave filter comprises a cuboidal dielectric block of dielectric material, through which one or more holes are formed. One or more through-holes are provided with internal conductors on their internal surfaces while the dielectric block is provided on its external surface with an external conductor acting as an earth electrode. The internal conductors are electrically separated from the earth electrode by shaving off a part of an electrode on one end face of the dielectric block, from which the one or more holes extends therethrough. A filter with a hole is called a coaxial filter, and a filter with more than one holes is called a comb line filter. The coaxial filter comprises providing inner conductors on inner walls of resonators of the coaxial type, respectively, which are dielectric, locating the resonators between terminals, and connecting the inner conductors in series to the terminals through capacitors (See U.S. Pat. No. 4,799,033, FIG. 5 and FIG. 6). The comb line filter comprises providing holes in a cuboidal dielectric block of dielectric material along a center line thereof with an equal interval interposed between them, forming inner conductors of plating on inner walls of the holes, providing conductors on those faces of the dielectric except the top face thereof at which the holes are opened, and connecting the inner conductors located on both sides to terminals through capacitors (See U.S. Pat. No. 4,799,033, FIG. 7 and FIG. 8). An external coupling to the circuit board is made by forming a signal input-output terminal on the external surface of the dielectric block (See U.S. Pat. No. 4,879,533, FIG. 1). In many cases, the input-output terminal is made up of a metal lead.

However, the conventional dielectric filter including a metal lead form of input-output terminal is found to have the following problems.

(1) The input-output terminal has a low tensile strength.

(2) Upon excessive heat applied to the dielectric filter mounted on a circuit board, there is often a variation of the filter characteristics due to the fusing of solder by which the input-output terminal is fixed in place.

(3) Some considerable expense is needed because of not a few steps needed to mount the input-output terminal on the dielectric filter and a cost of the input-output terminal per se.

As known in the art, such problems as mentioned above may be solved by use of a dielectric filter comprising an input-output terminal electrode formed on the surface mounting face of the dielectric filter (See U.S. Pat. No. 4,879,533, FIG. 4A).

In a dielectric filter comprising an input-output terminal electrode formed on the surface mounting face of the dielectric filter, the external conductor and input-output terminal electrode are formed in the following manner. Ceramic material powders are first pressed and fired to obtain a dielectric block. Then, one portion—to be provided thereon with an input-output terminal electrode—of one face of the dielectric block which provides a surface mount face is dipped in an electrically conductive coating material while masked according to an input-output terminal electrode pattern, followed by firing. Subsequently, an electrically conductive coating material is screen printed on the portion masked as mentioned above according to a pattern depending on the required purpose of the filter, and then fired to form an input-output terminal electrode that is an electrode for external coupling purposes. Finally, while the electrical properties of the thus fabricated dielectric filter are measured, a part of the electrode is shaved off for the regulation of resonance frequency. However, this process is found to have the following problems.

(1) To prevent chipping of the dielectric block, the edges of the dielectric block should be chamfered during its formation. Due to the presence of such chamfered edge areas, however, it is difficult to carry out printing for the formation of the input-output terminal electrode.

(2) When the dielectric block is obtained by axial-direction pressing, the green density of the dielectric block decreases substantially at its central area. Consequently, the dielectric block contracts more largely in the vicinity of its central area due to a shrinkage upon firing; the surface mount face of the filter fails to provide any flat plane. It is thus difficult to carry out printing for the formation of the input-output terminal electrode.

(3) The face of the dielectric block on which the input-output terminal electrode is to be mounted is unstable. This makes the electrode area of the input-output terminal susceptible to variations. Consequently, the input-output capacity value of the dielectric filter varies with a variation of the filter characteristics.

In view of the aforesaid problems, it is an object of the present invention to provide an inexpensive dielectric filter which has uniform filter characteristics, and is fabricated through a reduced number of steps with no need of any regulation operation, and a fabrication method thereof.

SUMMARY OF THE INVENTION

As recited in claim 1, 3 or 4, the present invention provides a dielectric filter comprising a polyhedral dielectric block, a first conductor formed in said dielectric block, a second conductor formed on said dielectric block in non-contact relation to said first conductor on one end face of the dielectric block, and an abraded surface formed on at least one side of said dielectric block, and a signal input-output terminal electrode formed on said abraded surface. In this embodiment of the present invention, the input-output terminal electrode is formed on the abraded surface so that it can be patterned. Further, the input-output terminal electrode can be formed with high precision because the post-firing deformation of the dielectric block due to a green density difference during its formation can be eliminated by abrasion so that the surface to be provided thereon with the input-output terminal electrode can be made flat. Furthermore, the input-output terminal electrode can be formed as far as the extreme end of the aforesaid abraded face. Consequently, the input-output capacity value of the dielectric filter is so stable that variations of the filter characteristics can be minimized. It is thus possible to fabricate an inexpensive dielectric filter through a reduced number of steps, with no need of any regulation operation yet in improved yields upon non-regulation.

As recited in claim 2, the present invention provides a dielectric filter in which an input-output terminal electrode is integrated with a dielectric block by direct printing or the like. This makes it possible to stabilize the printing face on which the input-output terminal electrode is to be formed, and the electrode area of the input-output terminal, so that the input-output capacity value of the dielectric filter can be stabilized with substantial removal of variations of the filter characteristics. It is thus possible to provide an inexpensive dielectric filter through a reduced number of process steps, with improved yields upon non-regulation.

As recited in claim 5, 6, 7, 8 or 9, the present invention provides a dielectric filter comprising a dielectric block having one or more holes in an axial direction thereof, a first conductor provided on an inner surface or surfaces of said one or more holes, a second conductor provided on an external face of said dielectric block except one end face in which said one or more holes are formed, and an abraded face taking no part in formation of said one or more holes. Since an input-output terminal electrode is formed on the abraded face, it is possible to pattern the required input-output terminal electrode. Further, it is possible to form the input-output terminal electrode with high precision because the face on which the input-output terminal electrode is to be formed is made flat by removal of the post-firing deformation of the dielectric block due to a green density difference upon pressing. Furthermore, it is possible to form, with high precision, the input-output terminal electrode as far as the extreme end of the face on which it is formed because chamfered edge areas provided for prevention of chipping of the dielectric block are removed by abrasion. The input-output capacity value of the dielectric filter is thus stabilized with minimized variations of the filter characteristics. This is the reason the present invention enables an inexpensive dielectric filter to be fabricated through a reduced number of process steps with no need of any regulation operation yet with improved yields upon non-regulation.

As recited in claim 10, 11, 12, 13, 14, 15, 16, 17 or 18, the present invention provides a method of fabricating a dielectric filter wherein, after formation of an electrode by dipping of a dielectric block in a pasty, electrically conductive coating material such as silver, and palladium, and baking, a part of the electrode is abraded off to form an input-output terminal electrode, so that the input-output terminal electrode can be obtained with high precision. The input-output capacity value of the dielectric filter is thus stabilized with minimized variations of the filter characteristics. This is the reason the present invention enables an inexpensive dielectric filter to be fabricated through a reduced number of process steps with no need of any regulation operation.

BRIEF DESCRIPTION OF THE DRAWINGS

The above and other objects, features, and advantages of the present invention will be better understood from the following description in conjunction with the accompanying drawings, in which.

DETAILED EXPLANATION OF PREFERRED EMBODIMENTS OF THE INVENTION

Figure 1:
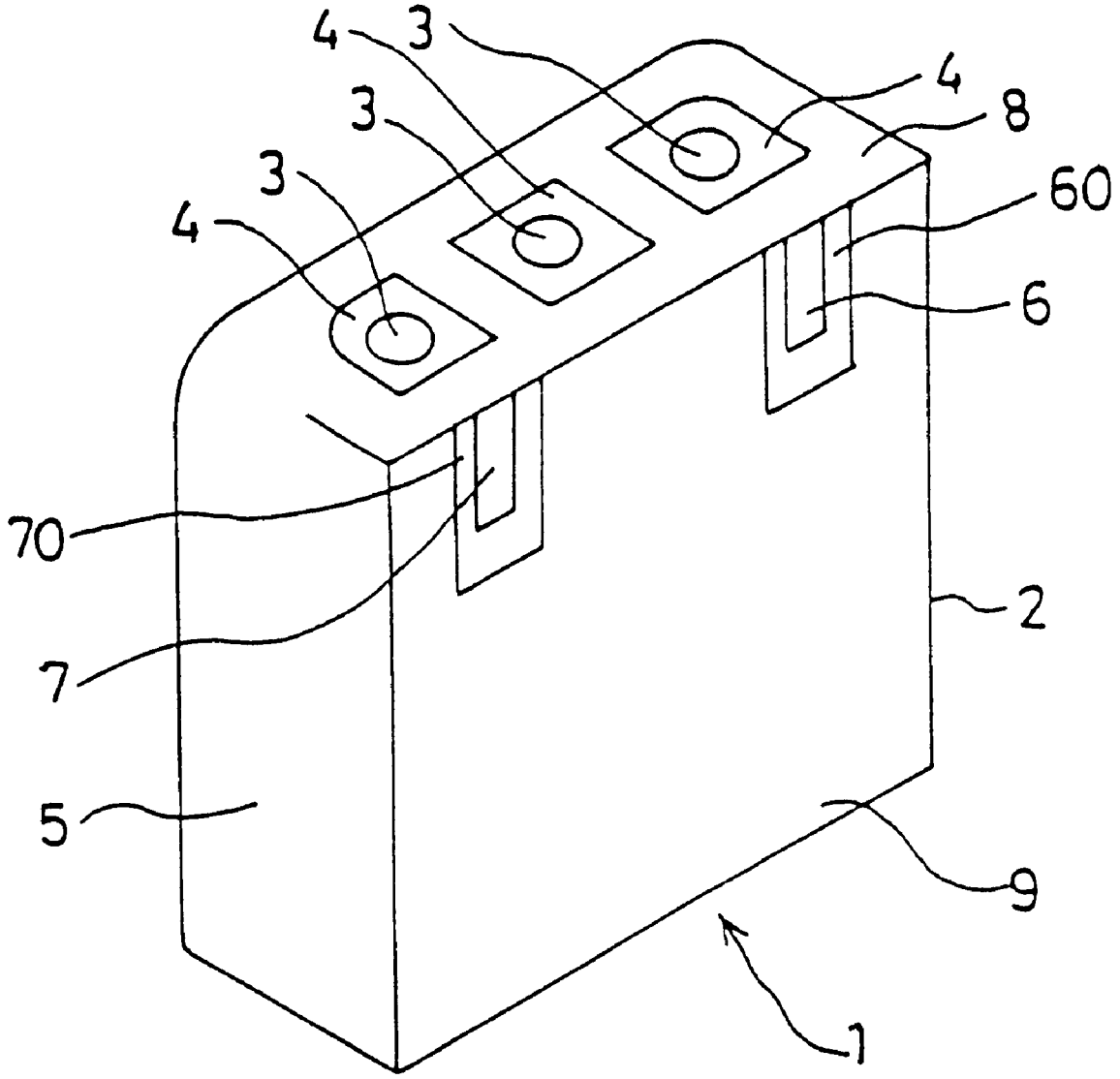
FIG. 1 is a perspective view of one embodiment of the dielectric filter according to the present invention.
Figure 2:
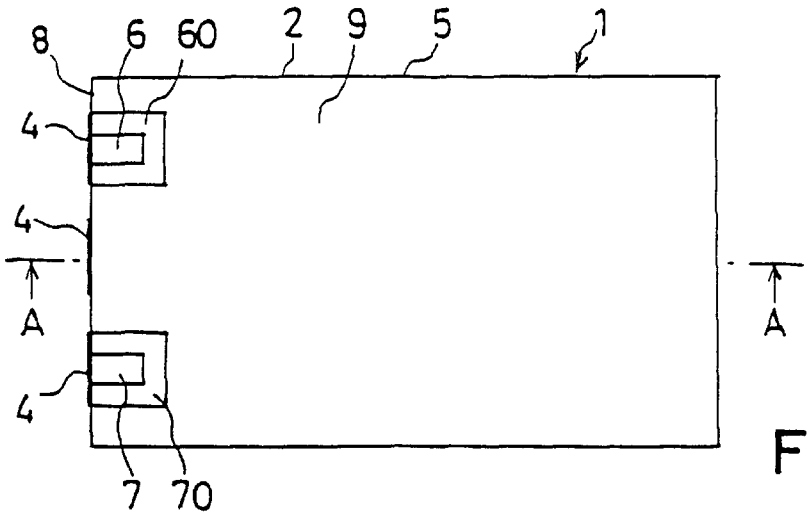
FIG. 2 is a plan view of one embodiment of the dielectric filter according to the present invention.
Figure 3:
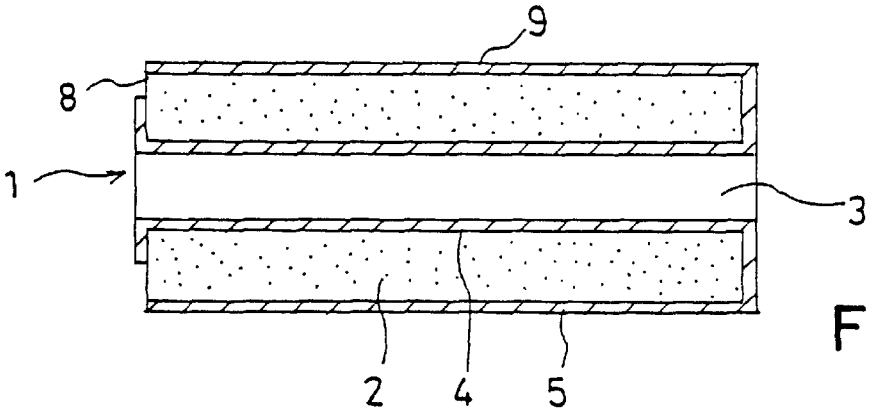
FIG. 3 is a sectional view taken along the A—A line in FIG. 2.

One embodiment of the dielectric filter according to the present invention is shown in FIGS. 1 to 3. FIG. 3 shows a dielectric filter 1 of a three-stage resonator structure of FIGS. 1 and 2, as taken along an axial direction of a through-hole 3. By way of example, this dielectric filter 1 may be used for portable devices for mobile radio communications such as earphones, portable telephones, and radio telephones. A polyhedral dielectric block 2 of dielectric material is provided with three through-holes 3. A continuous electrode extends from a substantially square area surrounding a hole opening 3 in one end face 8 of the dielectric block along an internal surface of the hole 3 to form an internal conductor 4 acting as a first conductor. A surface of the dielectric block 2 except the aforesaid one end face 8 is provided with an external conductor 5 acting as a second conductor or an earth electrode. An abraded face 9 is formed on a surface mount area at which the dielectric filter is coupled to a circuit board (not shown). On this abraded face 9 signal input-output terminal electrodes 6 and 7 for external coupling are formed via substantially C-shaped non-electrode area 60 and 70 while they are in no contact with the external conductor 5.

Figure 4:
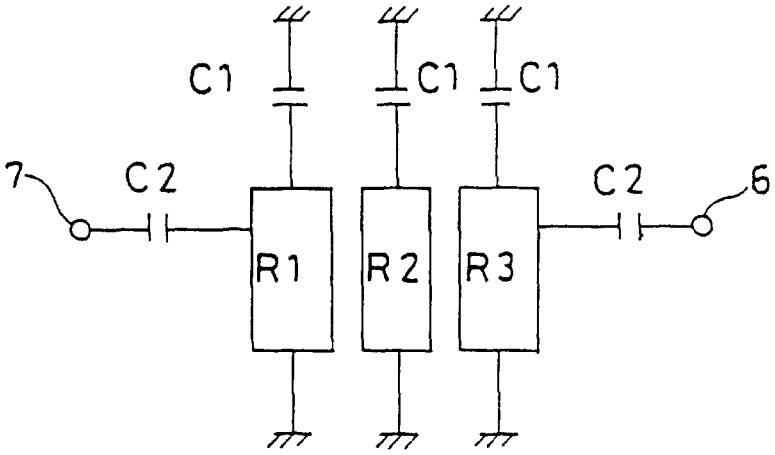
FIG. 4 is an equivalent circuit diagram for one embodiment of the dielectric filter according to the present invention.

An equivalent circuit diagram for the dielectric filter 1 shown in FIGS. 2 and 3 is presented as FIG. 4 wherein a resonator defined by the internal conductor 4 in each through-hole 3 is indicated at R1, R2, and R3, respectively. C1 represents a tip capacity defined between the internal conductors 4 and the external conductor 5, and C2 represents an external coupling capacity defined between the internal conductors 4 and the input-output electrodes 6, and 7. The dielectric filter 1 according to this embodiment acts as a band-pass filter.

The fabrication method of the dielectric filter 1 is then explained with reference to FIG. 5.

Figure 5:
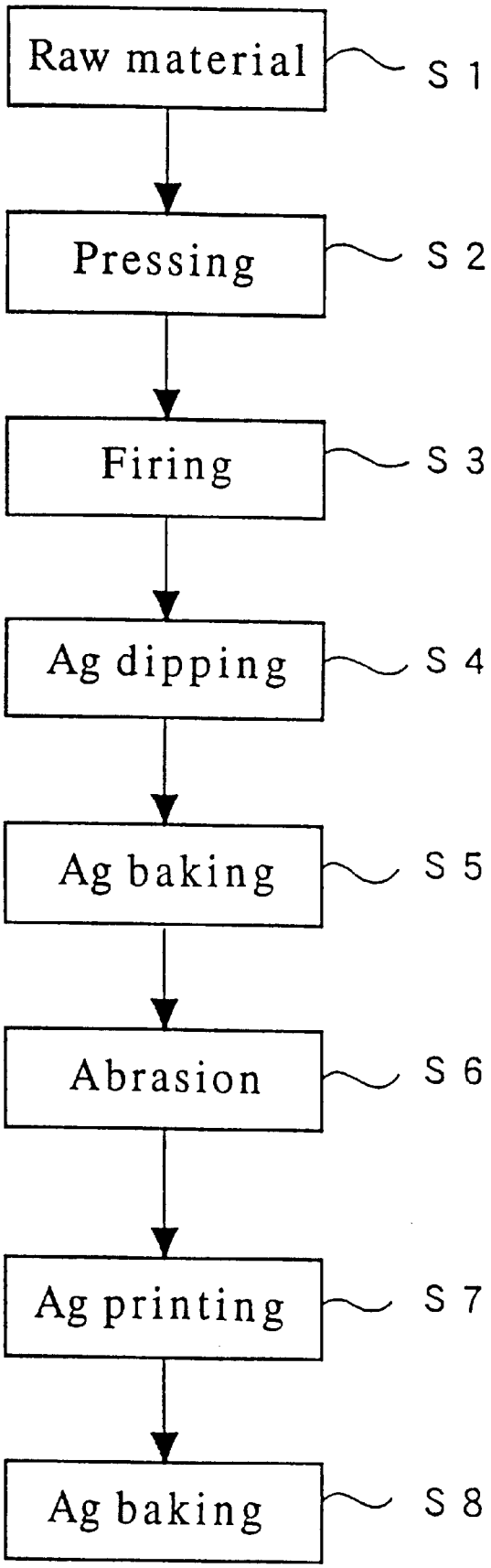
FIG. 5 is a flow chart illustrative of a fabrication method for one embodiment of the dielectric filter according to the present invention.

(1) At a step S1 shown in FIG. 5, calcined powders of dielectric material based on $BaO—TiO_2—Bi_2O_3$ as an example are well milled with a binder such as acrylic or butyral resin and a solvent such as toluene, xylene or alcohol for granulation.

Figure 6:
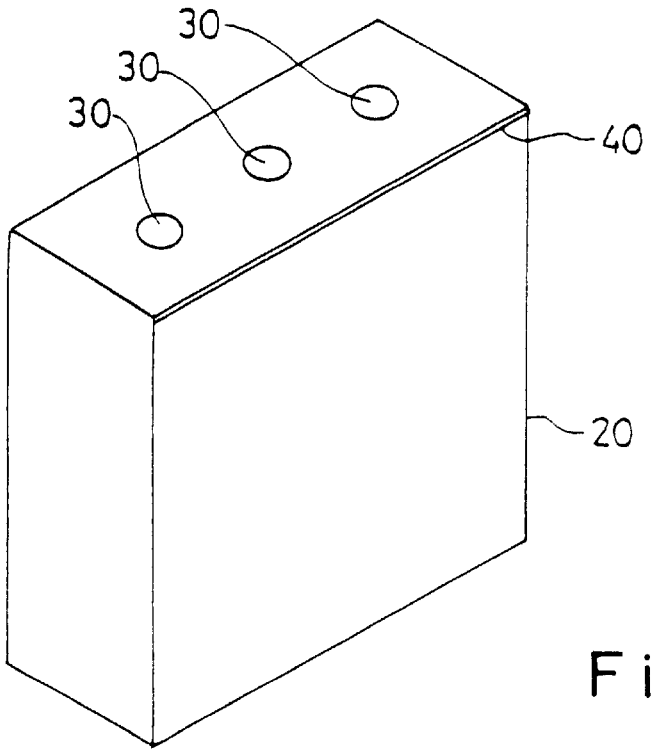
FIG. 6 is a perspective view of one embodiment, before firing, of the dielectric block according to the present invention.

(2) At a step S2 shown in FIG. 5, integral molding is carried out in a mold using a press. At the same time as pressing, holes 30 are formed through a dielectric block 20 before firing, as depicted in FIG. 6. In this case, the pressing is carried out in an axial direction of each through-hole 30. The green density of the dielectric block 20 before firing decreases substantially at its central area. The dielectric block 20 before firing is provided with a chamfered edge area 40 for the purpose of prevention of chipping.

Figure 7:
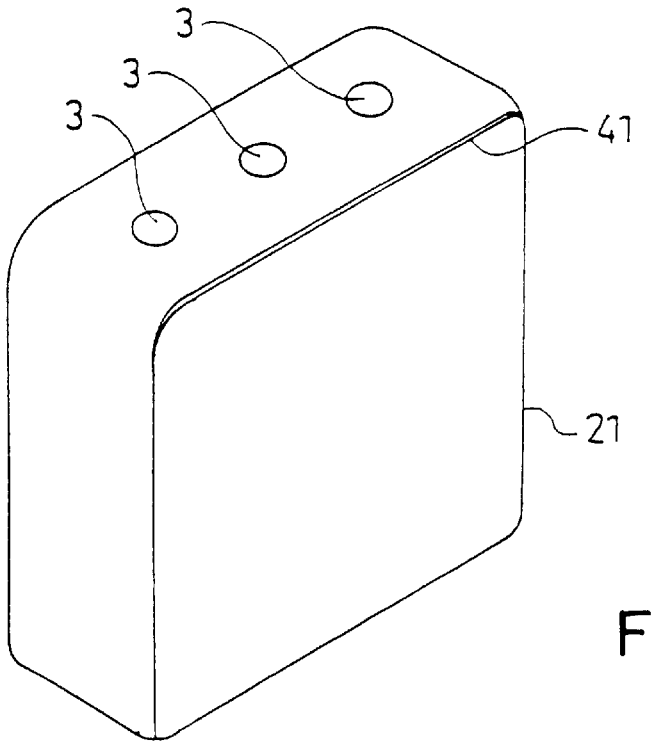
FIG. 7 is a perspective view of one embodiment, before provided with electrodes on its surface, of the dielectric block according to the present invention.

(3) At a step S3 shown in FIG. 5, the dielectric block 20 before firing is held and fired at 1,340° C. for 2 hours in the air using an electrically operated continuous belt furnace to form a dielectric block 21 to be provided with an electrode on its surface, as shown in FIG. 7. At this time, the dielectric block 21 to be provided with electrodes on its surface contracts substantially at its central area due to a shrinkage upon firing, so that the block surface can bend while the chamfered edge area 41 can curve.

(4) At a step S4 shown in FIG. 5, the dielectric block 21 is dipped in an electrically conductive coating material such as an Ag paste before it is provided with an electrode on its surface, thereby coating the electrically conductive coating material all over the surface of the dielectric block 21. Simultaneously with this, the internal surfaces of the holes 3 shown in FIG. 7 are also coated with an electrically conductive coating material such as an Ag paste.

Figure 8:
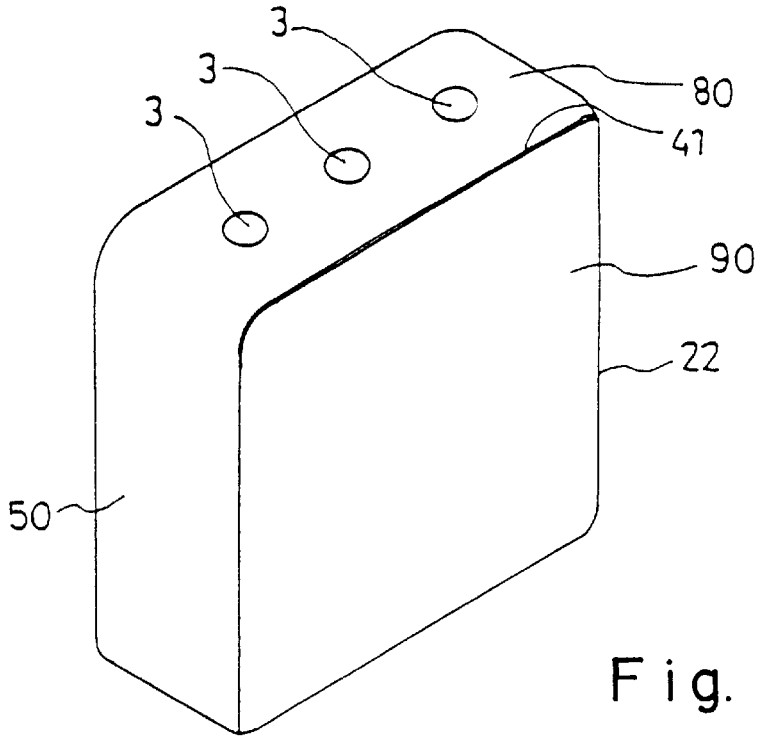
FIG. 8 is a perspective view of one embodiment, before abrasion, of the dielectric block according to the present invention.

(5) At a step S5 shown in FIG. 5, the Ag paste or other conductive coating material coated by dipping at step S4 is baked at 840° C. for 10 minutes, thereby forming an electrode 50 on the external surface of a dielectric block 22 before abrasion, as depicted in FIG. 8.

Figure 9:
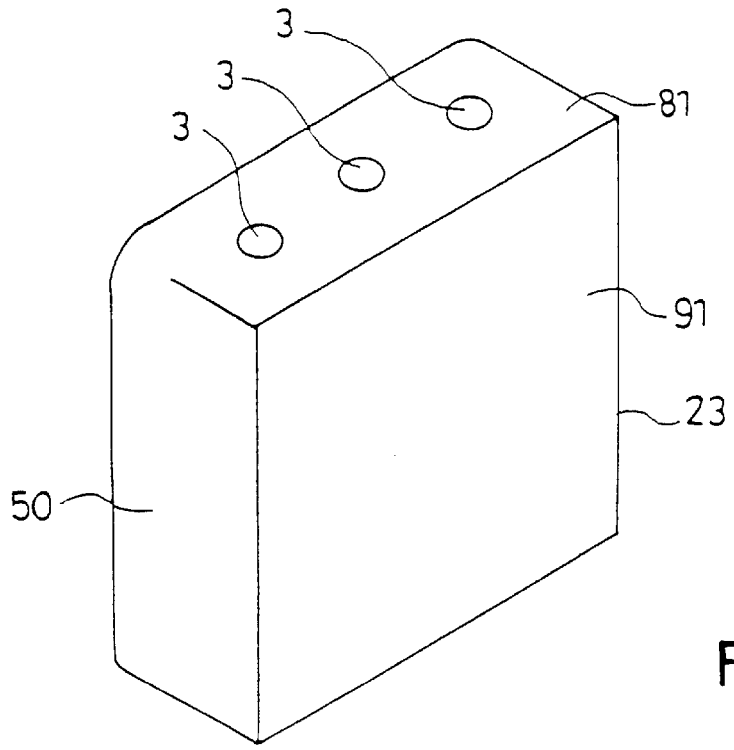
FIG. 9 is a perspective view of one embodiment, after abrasion, of the dielectric block according to the present invention.

(6) At a step S6 shown in FIG. 5, one end face 80 of the dielectric block 22 shown in FIG. 8, and one face 90 of a portion of the dielectric block 22 to be provided with a signal input-output electrode are abraded with a cutting tool having a flat cutting plane such as a #400 diamond cutting disk. At this time, the dielectric block 22 can be stripped of the chamfered edge area 41 by abrasion. Subsequent washing with a solvent such as toluene or acetone yields a dielectric block 23 upon abrasion, as depicted in FIG. 9.

(7) At a step S7 shown in FIG. 5, another end face 81 of the dielectric block 23 upon abrasion, and another face 91 of the portion of the dielectric block 23 to be provided with a signal input-output electrode are screen printed with an Ag paste or other conductive coating material according to the pattern desired for the required dielectric filter. At this time, screen printing can be carried out with high printing precision because another end face 81 and another face 91 are kept flat by abrasion. Also, since the chamfered edge area is removed by abrasion, high-precision printing can be carried out as far as the extreme end of another face 91.

(8) At a step S8 shown in FIG. 5, the Ag paste or other conductive coating material printed at step S7 is baked at 840° C. for 10 minutes, so that such a dielectric filter as shown at 1 in FIG. 1 can be obtained. In this dielectric filter, a substantially square form of electrode extends from around the hole opening 3 in the one end face 8 thereof along the internal surface of the hole 3, and the internal conductor 4 is electrically connected to the electrode on the internal surface of the hole 3. The portion of the external face of the dielectric block 2 except the one end face 8 is provided with the external conductor 5. The input-output terminal electrodes 6 and 7 are formed on the abraded face 9 via the substantially C-shaped non-electrode areas 60 and 70 while they are in no contact relation to the external conductor 5.

The thus fabricated dielectric filter 1 is of the surface mount type, and is soldered onto a circuit board with the input-output terminal electrodes 6, 7 and external conductor 5.

Figure 10:
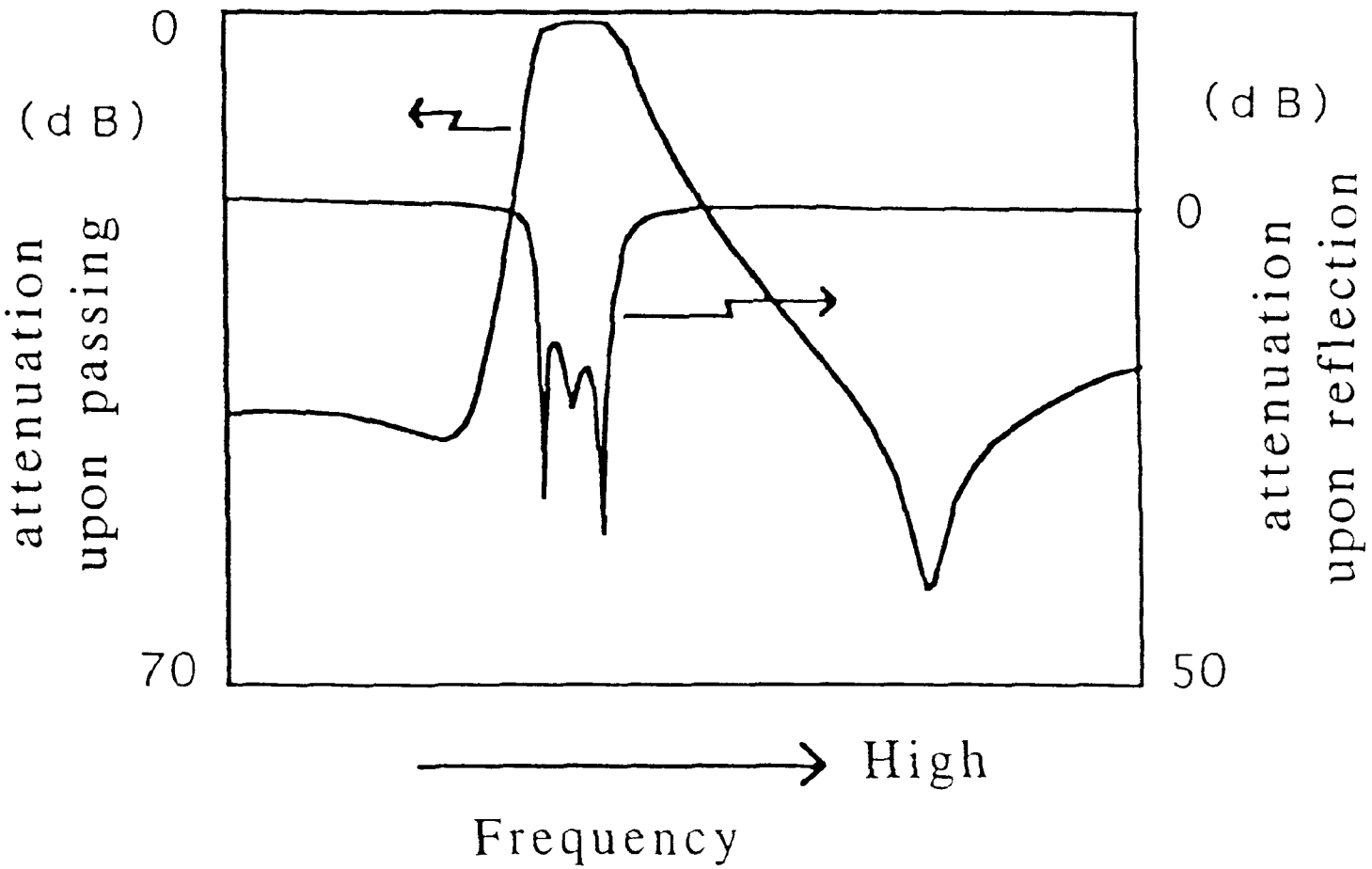
FIG. 10 is a characteristic data diagram illustrative of the electrical properties of one embodiment of the dielectric filter according to the present invention.

Of the electrical properties of the dielectric filter 1 fabricated through Steps 1 to 8 shown in FIG. 5, the frequency vs. attenuation upon passing, and attenuation upon reflection relations are plotted in FIG. 10. As can be seen from FIG. 10, a plurality of attenuation peaks are included in the waveform of the attenuation upon reflection. In other words, the input-output capacity values of the dielectric filter 1 can be well stabilized. In a conventional dielectric filter, the filter characteristics are regulated by the regulation of resonance frequency while the internal conductors around the holes in the one end face are shaved off. According to this embodiment of the invention, however, the regulation of resonance frequency may be dispensed with because the input-output terminal electrodes 6 and 7 are formed with so high precision that variations of the input-output capacity value of the dielectric filter 1 can be minimized. It is thus possible to reduce the number of fabrication process steps.

According to this embodiment, one end face of the electrode coated all over the surface of the dielectric block by dipping and one face of the area on which the signal input-output terminal electrodes are to be formed are abraded for the formation of the internal conductors 4, external conductor 5, and input-output terminal electrodes 6 and 7. It is thus possible to screen print the Ag paste or other conductive coating material on the abraded faces according to the pattern depending on the required purpose of the dielectric filter. Further, it is possible to achieve high-precision screen printing because the printing faces are kept flat by abrasion. Furthermore, it is possible to achieve high-precision printing as far as the extreme end of one face on which the signal input-output terminal electrodes are to be formed. It is thus possible to form the input-output terminal electrodes with high precision, thereby stabilizing the input-output capacity value of the dielectric filter 1 and minimizing variations of the filter characteristics, with improved yields upon non-regulation. This is the reason the present invention enables an inexpensive dielectric filter to be fabricated through a reduced number of process steps.

In the embodiment explained above, the input-output terminal electrodes 6 and 7 are formed on one face of the dielectric block 2. In the present invention, however, it is to be understood that the input-output terminal electrodes may be provided astride a plurality of dielectric block faces or on the faces of the dielectric block except the one face in which the through-holes are to be formed. When the input-output terminal electrodes are formed astride a plurality of dielectric block faces, however, it is to be noted that these faces are preferably abraded. In this embodiment, the dielectric filter 1 is explained with reference to a band-pass filter. In the present invention, however, it is understood that the dielectric filter 1 may be used in the form of a high pass filter, a low pass filter, and a band-elimination filter, and that the number of stages in the dielectric filter is not critical.

In the instant embodiment, the internal conductors 4, external conductor 5, and input-output terminal electrodes 6 and 7 provided on the dielectric filter 1 are formed of silver or Ag. In the present invention, however, it is to be understood that other metals such as palladium or Pd, gold or Au, copper or Cu, non-magnetic nickel or Ni, non-magnetic cobalt or Co, or an alloy containing at least one of these metals may be used.

In the instant embodiment, a part of the internal conductors 4 and external conductor 5, and the input-output terminal electrodes 6 and 7 are formed by screen printing a conductive coating material on the dielectric block upon abrasion. In the present invention, however, it is to be understood that these may be formed by pad printing.

In the instant embodiment, the electrodes providing the internal conductors 4 and external conductor 5 are formed on the dielectric block before abrasion by the dip coating of the conductive coating material. In the present invention, however, it is understood that they may be formed by electroless plating or electroplating.

While the invention has been described with reference to a preferred embodiment, it will be understood by those skilled in the art that various changes may be made without departing from the scope of the invention. In addition, many modifications may be made to adapt a particular situation or material to the teachings of the invention without departing from the essential scope thereof. It is therefore intended that the invention not be limited to the particular embodiment disclosed as the best mode contemplated for carrying out the invention, but that the invention will include all embodiments falling within the scope of the appended claims.

I claim:

1. A dielectric filter comprising:

a polyhedral dielectric block, a first conductor formed on said dielectric block, a second conductor formed on said dielectric block while said second conductor is in no contact with said first conductor on one end face of the dielectric block, a flat abraded face completely formed on at least one side of said dielectric block, and a signal input-output terminal electrode formed on said flat abraded face while said terminal electrode is in no contact with said second conductor.

2. The dielectric filter according to claim 1, wherein said input-output terminal electrode is integrated with said abraded face by means of direct printing.

3. The dielectric filter according to claim 1, wherein said first conductor, said second conductor, and said input-output terminal electrode are each formed of a conductor material comprising at least one of silver, palladium, gold, copper, non-magnetic nickel, and non-magnetic cobalt.

4. The dielectric filter according to claim 1, which is selected from a group consisting of a band-pass filter, a high pass filter, a low pass filter, and a band-elimination filter.

5. A dielectric filter comprising:

a polyhedral dielectric block, a first conductor formed on said dielectric block, a second conductor formed on said dielectric block while said second conductor is in no contact with said first conductor on one end face of the dielectric block, a flat abraded face completely formed on at least one side of said dielectric block, and a signal input-output terminal electrode formed on said abraded face while said terminal electrode is in no contact with said second conductor, wherein:

said dielectric block has a hole in an axial direction thereof, said first conductor is formed on an internal surface of said hole, said second conductor is formed on an external surface of said dielectric block except one end face thereof in which said hole is formed, and said abraded face takes no part in formation of said hole.

6. The dielectric filter according to claim 5, wherein a plurality of holes are provided.

7. The dielectric filter according to claim 5, wherein said input-output terminal electrode is integrated with said abraded surface by means of direct printing.

8. The dielectric filter according to claim 5, wherein said first conductor, said second conductor, and said input-output terminal electrode are each formed of a conductor material comprising at least one of silver, palladium, gold, copper, non-magnetic nickel, and non-magnetic cobalt.

9. The dielectric filter according to claim 5, which is selected from a group consisting of a band-pass filter, a high pass filter, a low pass filter, and a band-elimination filter.

* * * * *